United States Patent [19]

Heilman

[11] Patent Number: 5,005,720

[45] Date of Patent: Apr. 9, 1991

[54] PLASTIC CAP WITH BREAKAWAY TAMPER BAND AND METHOD OF FORMING SAME

[75] Inventor: Robert J. Heilman, Orland Park, Ill.

[73] Assignee: Continental White Cap, Inc., Norwalk, Conn.

[21] Appl. No.: 314,960

[22] Filed: Feb. 24, 1989

[51] Int. Cl.[5] ..... B65D 41/32

[52] U.S. Cl. ..... 215/252; 264/297.8

[58] Field of Search ..... 215/252, 258, 253; 220/268, 276

[56] References Cited

U.S. PATENT DOCUMENTS

| | | | |
|---|---|---|---|
| 2,444,506 | 7/1948 | Hammer | 215/253 X |
| 2,546,566 | 3/1951 | Schweizer | 215/250 |
| 2,854,003 | 9/1958 | Kirsch | 215/258 X |
| 3,441,161 | 4/1969 | Van Baarn | 215/235 |
| 3,473,685 | 10/1969 | Karlan | 215/DIG. 1 |
| 3,901,403 | 8/1975 | Menke | 215/258 |
| 3,976,215 | 8/1976 | Smalley | 215/233 |
| 4,479,586 | 10/1984 | Csaszar | 215/258 |
| 4,506,795 | 3/1985 | Herr | 215/252 |
| 4,519,516 | 5/1985 | Amos | 215/252 |
| 4,546,893 | 10/1985 | Stull | 215/256 |
| 4,694,970 | 9/1987 | Heilman | 215/276 |
| 4,744,480 | 5/1988 | Luch et al. | 215/258 X |

FOREIGN PATENT DOCUMENTS

| | | | |
|---|---|---|---|
| 234593 | 9/1959 | Australia | 215/252 |
| 93000 | 6/1962 | Denmark | 215/252 |
| 422557 | 4/1967 | Switzerland | 215/252 |
| 1209395 | 10/1970 | United Kingdom | 215/252 |

*Primary Examiner*—Stephen Marcus

*Attorney, Agent, or Firm*—Charles E. Brown; Paul Shapiro; Charles A. Brown

[57] ABSTRACT

This relates to a plastic closure cap for containers wherein the closure cap has a tamper indicating band for locking beneath a transfer bead on a container neck finish to indicate tampering. The closure cap is molded as an intermediate article of manufacture with the tamper indicating band being formed integrally with the skirt of the closure cap. The article also includes a plurality of circumferentially spaced, axially extending and radially outwardly directed protrusions which bridge across the skirt and tamper indicating band. The closure cap is formed from the intermediate article of manufacture by horizontally slitting the lower part of the closure cap along the intended line of juncture between the tamper indicating band and closure cap skirt. The slitting also extends into the protrusions leaving the protrusions with only a small connecting portion and the protrusions becoming straps which open to permit the tamper indicating band to separate from the lower edge of the skirt sufficiently to receive the transfer bead of the container neck finish. These straps rupture when the closure cap is removed after the tamper indicating band is locked beneath the transfer bead of the closure neck finish. If desired, that portion of the intermediate article of manufacture which becomes the lower edge portion of the skirt may be formed with axially extending, circumferentially spaced slits which permit a deformation of the lower part of the closure cap skirt as it engages over the transfer bead.

5 Claims, 1 Drawing Sheet

PLASTIC CAP WITH BREAKAWAY TAMPER BAND AND METHOD OF FORMING SAME

This invention relates in general to new and useful improvements in plastic closure caps having tamper indicating bands which break away from the closure cap during the removal of the closure cap so as to indicate tampering.

Tamper indicating bands which are connected to skirts of plastic closure caps per se are old and well known. This invention in particular relates to a tamper indicating band construction wherein the band is initially fully integrally attached to the skirt of the closure cap and thereafter is separated therefrom by slitting along the line of juncture between the tamper indicating band and the closure cap skirt. After slitting, the tamper indicating band remains attached to the closure cap skirt by a plurality of rupturable straps which are initially formed as circumferentially spaced protrusions integral with both the skirt and the tamper indicating band.

Such an arrangement is broadly known in the patent to Hayes 4,694,970 granted Sept. 22, 1987. However, these protrusions are also slit in the slitting of the closure cap so as to define strap means which, during the application of the closure cap to a container neck finish, opens and permits the tamper indicating band to be spaced downwardly relative to the closure cap skirt so that a conventional transfer bead on the container neck finish will project between the tamper indicating band and the skirt with the tamper indicating band locking beneath the transfer bead.

If desired, the skirt, immediately above the tamper indicating band, may be provided with axial, radially extending slits so that the skirt may deform radially outwardly against the upper surface of the transfer bead. Also, if desired, the lower internal surface of the tamper indicating band may be tapered so as to facilitate engagement thereof over the transfer bead and the movement of the tamper indicating band below the transfer bead.

With the above and other objects in view that will hereinafter appear, the nature of the invention will be more clearly understood by reference to the following detailed description, the appended claims, and the several views illustrated in the accompanying drawing.

Figure 6:
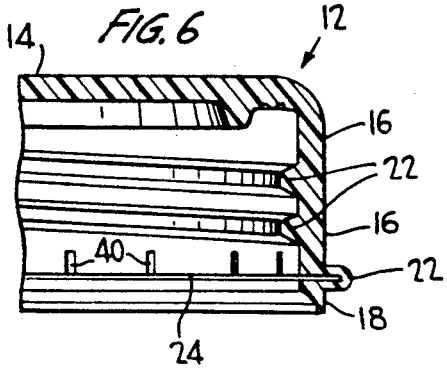
FIG. 6 is a fragmentary sectional view taken through a modified form of closure cap wherein the lower part of the skirt is provided with axially extending, circumferentially spaced slits.
Figure 7:
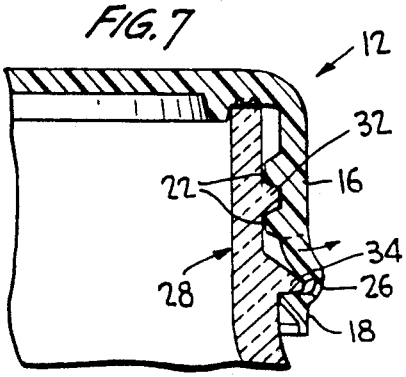

FIG. 7. is a fragmentary sectional view showing the closure cap of FIG. 6 applied to a container neck finish and the radially outward deflection of the lower part of the closure cap skirt.

Figure 1:
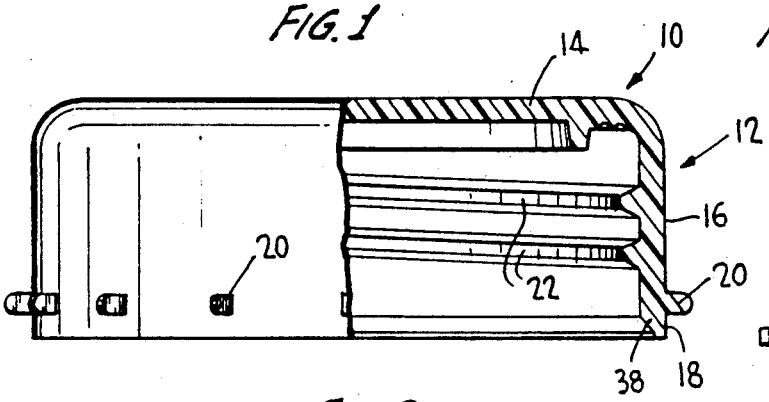
FIG. 1 is an elevational view with parts broken away of a newly molded plastic closure cap formed in accordance with this invention.
Figure 3:
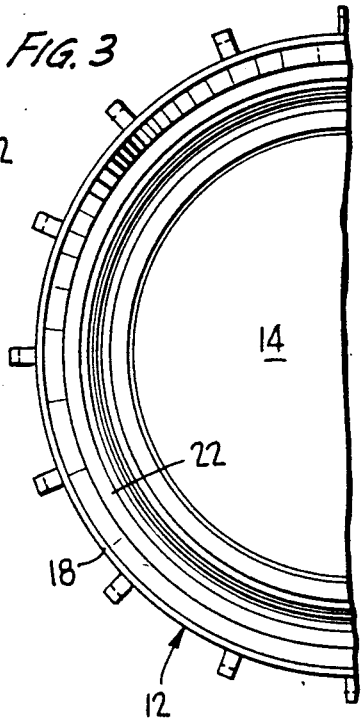
FIG. 3 is a fragmentary bottom plan view of the closure cap taken generally along the line 3—3 and shows further the details thereof.
Figure 2:
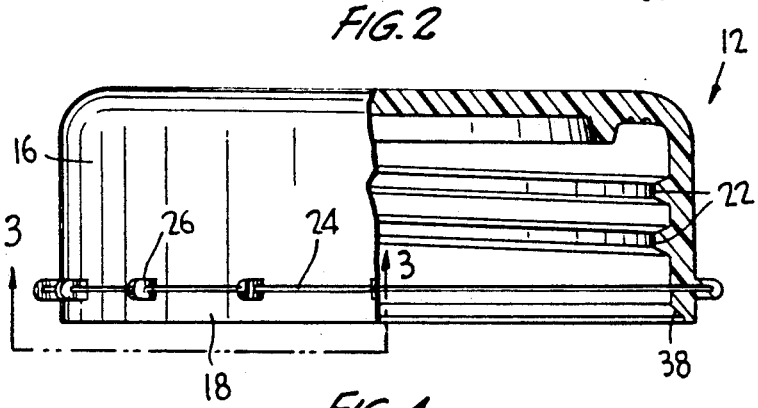
FIG. 2 is an elevational view with parts broken away similar to FIG. 1 showing the closure cap modified by being slit entirely through the thickness thereof and partially through the protrusions so as to separate the tamper indicating band from the closure cap skirt.
Figure 4:
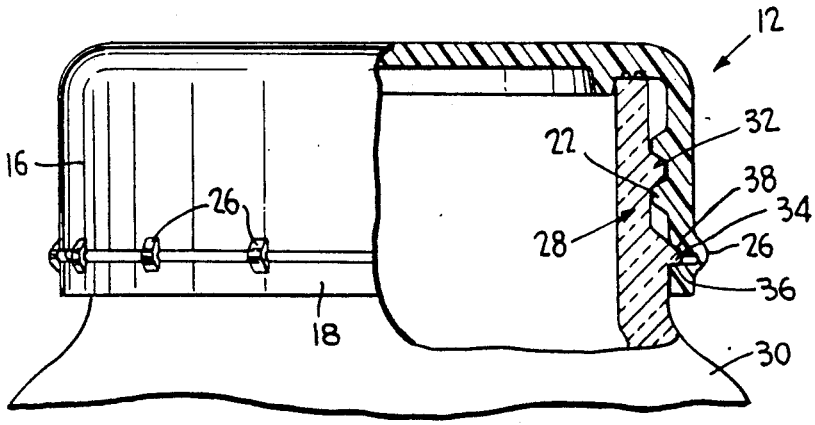
FIG. 4 is an elevational view of the closure cap with parts broken away and shows the closure cap applied to a conventional container neck finish with the tamper indicating band locked beneath the transfer bead of the container neck finish.

Referring now to the drawing in detail, reference is made to FIG. 1 wherein there is illustrated an intermediate article of manufacture generally identified by the numeral 10. The intermediate article 10 is in the form of a plastic cap 12 including an end wall 14 and an integral depending skirt 16. Further, at the lower edge of the skirt 16 there is integrally connected to the skirt 16 without interruption a tamper indicating band 18. The intermediate article of manufacture 10 also includes a plurality of circumferentially spaced, axially extending, radially projecting protrusions 20. The protrusions 20 are in part joined to the lower part of the skirt 16 and in part joined to the tamper indicating band 18.

The closure cap 12 is preferably of the type wherein the skirt 16 is provided with internal threads 22 for threaded engagement with a thread on a container neck finish to be described hereinafter.

It is to be understood that the intermediate article of manufacture 10 is molded from a suitable plastic material either by compression molding or injection molding. The skirt 16 is of the same internal diameter below the threads 22 as above the threads 22. Further, no groove is provided for the transfer bead of the container neck finish to fit into.

After being formed by molding, the intermediate article of manufacture 10 is modified by a horizontal slit 24 being made from the inside of the closure cap 12 using a cutting blade (not shown). The cut goes completely around the circumference of the closure cap to a depth that the cut nearly, but not quite, severs the protrusions 20. The result of the slit 24 is to separate the tamper indicating band 18 from the skirt 16 and at the same time to convert the protrusions 20 into rupturable straps 26. The tamper indicating band 18 remains attached to the skirt 16 only through the small portions of the protrusions which are not cut.

The closure cap 12 is particularly adapted to be threaded onto a neck finish 28 of a conventional container 30 which may be in the form of a bottle. The container neck finish includes an external thread 32 and a transfer bead 34 which has a flat underside in the form of a locking shoulder 36. The upper surface of the transfer bead 34 may be tapered downwardly and outwardly as at 38.

Further, if desired, the lower interior surface of the tamper indicating bead 18 may be downwardly and outwardly tapered as at 38 to facilitate sliding of the tamper indicating band over the transfer bead 34.

When the closure cap 12 is applied to the container 30, the transfer bead 34 causes the tamper indicating band 18 to stretch. When the transfer bead centerline reaches the slit 24, the compressive forces in the stretched tamper indicating band cause the band to slide down over the transfer bead. The partially slit protrusions 20, now strap means 26, around the closure cap have been sticking out radially, but now open up where they were cut, allowing the slit to increase in width, thus allowing the tamper indicating band 18 to move down under the transfer bead shoulder 36.

Figure 5:
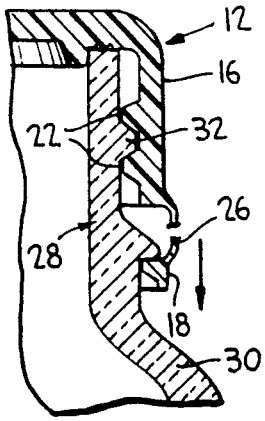
FIG. 5 is a fragmentary vertical sectional view showing the closure cap being removed by unthreading and the straps rupturing with the tamper indicating band remaining on the container neck finish below the transfer bead.

With the tamper indicating band 18 firmly locked beneath the transfer bead 36, when the closure cap 12 is removed by unscrewing, it will move up on the container neck finish as shown in FIG. 5, placing the strap means 26 in tension until they rupture, leaving the tamper indicating band 18 on the neck finish and thereby indicating tampering.

If the interference between the top edge of the slit 24 and the top of the transfer bead 34 is too great, it may be difficult to completely seat the closure cap. However, this can be overcome by providing a series of vertical slits running from the lower edge of the skirt 16 upwards into the skirt a short distance. These slits are best shown in FIG. 6 and identified by the numeral 40. The slits 40 will allow the lower edge of the cap skirt 16 to flare out slightly due to the interference of the skirt with the transfer bead 34 as is clearly shown in FIG. 7.

It is to be understood that the tamper indicating band 18, once the closure cap 12 is applied, will operate in the same manner as prior tamper indicating bands with the strap means 26 functioning as rupturable bridges.

The construction of the closure cap provides for several advantages which include:

1. Allows the use of a floating sleeve compression molding process to make the closure cap.

2. Permits the intermediate article of manufacture 10 to be easily stripped from the mold core (punch) since the tamper indicating band does not have to be removed from an undercut.

3. There is a simplicity of molding tooling.

4. The resultant closure cap requires less material since the tamper indicating band is of a simple construction and no material is required initially between the tamper indicating band and the lower edge of the closure cap skirt.

5. Because the tamper indicating band is cut perpendicular to the axis of the closure cap, the edge of the tamper indicating band which catches under the transfer bead is sharp and should catch the bead more positively than present tamper indicating bands.

Although only preferred embodiments of the closure cap and tamper indicating band assembly have been specifically illustrated and described, it is to be understood that modifications may be made in the closure cap and tamper band assembly without departing from the spirit and scope of the invention.

I claim:

1. A plastic cap having an integral tamper indicating band, said plastic cap having a skirt with said tamper indicating band being a continuation of said skirt and separated from said skirt by a single continuous slit extending entirely around and through said skirt, and a purality of radially outwardly projecting and circumferentially spaced protrusions joining said tamper indicating band to said skirt, said slit extending radially outwardly into said protrusions to form said protrusions as openable strap means for permitting axial separation of said tamper indicating band from said skirt to have received between said skirt and said tamper indicating band a transfer bead of a container to be closed by said plastic cap.

2. A plastic cap according to claim 1, wherein said strap means are rupturable in tension after opening to release said tamper indicating band from said skirt when said plastic cap is removed from an associated container.

3. A plastic cap according to claim 1, wherein said tamper indicating band is internally tapered to facilitate engagement of said tamper indicating band over a container transfer bead.

4. A plastic cap according to claim 1, wherein said skirt immediately adjacent said slit has axially extending and circumferentially spaced slits forming means for facilitating radially outward expansion of said skirt relative to a container transfer bead.

5. A plastic cap according to claim 4, wherein said tamper indicating band is internally tapered to facilitate engagement of said tamper indicating band over a container transfer bead.

* * * * *